US008093198B2

(12) United States Patent
Sunder et al.

(10) Patent No.: US 8,093,198 B2
(45) Date of Patent: Jan. 10, 2012

(54) METHOD FOR THE PRODUCTION OF PARTICULATE BLEACHING AGENT COMPOSITIONS

(75) Inventors: Matthias Sunder, Duesseldorf (DE); Peter Schmiedel, Duesseldorf (DE); Heinz-Juergen Voelkel, Langenfeld (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 209 days.

(21) Appl. No.: 12/499,168

(22) Filed: Jul. 8, 2009

(65) Prior Publication Data

US 2009/0270303 A1 Oct. 29, 2009

Related U.S. Application Data

(63) Continuation of application No. PCT/EP2008/050210, filed on Jan. 10, 2008.

(30) Foreign Application Priority Data

Jan. 22, 2007 (DE) ..... 10 2007 004 054

(51) Int. Cl.
*C11D 7/32* (2006.01)
*C11D 7/54* (2006.01)
*C11D 17/00* (2006.01)

(52) U.S. Cl. ..... 510/313; 510/309; 510/310; 510/375; 510/376; 510/501; 510/505; 252/186.26; 252/186.27

(58) Field of Classification Search ..... 510/303, 510/309, 310, 313, 372, 375, 376, 501, 505; 252/186.26, 186.27
See application file for complete search history.

(56) References Cited

U.S. PATENT DOCUMENTS

| | | | | |
|---|---|---|---|---|
| 5,061,807 | A | 10/1991 | Gethoeffer et al. | |
| 5,480,577 | A * | 1/1996 | Nicholson et al. | 510/372 |
| 6,322,748 | B1 * | 11/2001 | Hutton et al. | 422/1 |
| 2009/0075856 | A1 | 3/2009 | Schmiedel et al. | |
| 2009/0149368 | A1 | 6/2009 | Hildebrand et al. | |

FOREIGN PATENT DOCUMENTS

| | | | |
|---|---|---|---|
| CA | 2621471 | * | 3/2007 |
| EP | 0 325 328 | A1 | 7/1989 |
| EP | 0 349 940 | B1 | 1/1990 |
| EP | 0 510 761 | B1 | 10/1992 |
| EP | 0 653 485 | B1 | 5/1995 |
| EP | 0 695 343 | B1 | 2/1996 |
| EP | 0 816 481 | A2 | 1/1998 |
| WO | WO 97/14780 | | 4/1997 |
| WO | WO 2007/031387 | A1 | 3/2007 |
| WO | WO 2007/134977 | A1 | 11/2007 |

OTHER PUBLICATIONS

R. C. MacKenzie et al., Differential Thermal Analysis, A Review, The Macaulay Institute for Soil Research, Craigisbuckler, Aberdeen, vol. 87, (1962), pp. 420-434.
International Search Report dated Apr. 7, 2008.

* cited by examiner

*Primary Examiner* — Gregory DelCotto
(74) *Attorney, Agent, or Firm* — RatnerPrestia

(57) ABSTRACT

The production of bleaching agent granulates, wherein a particulate peroxide compound and a water soluble polymer which can be ionotropically cross-linked are granulated into a primary granulate using a liquid binding agent containing water, and the primary granulate is brought into contact with a cross-linking agent for the water soluble polymer which can be ionotropically cross-linked. A particle so obtained can be worked into liquid detergents and cleaning agents containing water and remain stable.

12 Claims, No Drawings

METHOD FOR THE PRODUCTION OF PARTICULATE BLEACHING AGENT COMPOSITIONS

CROSS-REFERENCE TO RELATED APPLICATIONS

This application is a continuation under 35 U.S.C. §§120 and 365(c) of International Application PCT/EP2008/050210, filed Jan. 10, 2008. This application also claims priority under 35 U.S.C. §119 of DE 10 2007 004 054.9, filed Jan. 22, 2007. The disclosures of PCT/EP2008/050210 and DE 10 2007 004 054.9 are incorporated herein by reference in their entirety.

BACKGROUND OF THE INVENTION

The present invention relates to a method of producing granules containing peroxy compounds and the granules obtainable in this manner. The present invention further relates to the use of these granules as a bleaching agent or bleaching agent component, in particular to the use thereof in particulate or liquid detergents and cleaning agents, and to the production thereof.

The particulate bleaching components conventionally used hitherto in detergents, such as for example alkali metal perborates or percarbonates, are highly moisture-sensitive, that is to say they often lose their bleaching action within a short time due to a loss of active oxygen, since even solid detergents and cleaning agents always have a certain water content or water penetration from the air is inevitable during storage thereof, if the bleaching agent component is not protected against moisture, for example by the application of a coating layer.

Peroxycarboxylic acids, in particular imidoperoxycarboxylic acids, the most important representative of which is phthalimidoperoxycaproic acid (PAP), are likewise known as bleaching components for detergents and cleaning agents; although these are less sensitive to hydrolysis than the stated inorganic compounds, their storage stability is insufficient to ensure long-term usability of the corresponding detergent or cleaning agent without an accompanying loss of activity.

Because of the disadvantages which arise in relation to a change in the detergent or cleaning agent formulation as a result of the degradation of the bleaching agent component such as imidoperoxycarboxylic acid, in particular PAP, it has been attempted in the prior art to encapsulate the imidoperoxycarboxylic acids (e.g. PAP) effectively, such that they cannot come into contact with the other components of the detergent or cleaning agent formulation.

For instance, European patent EP 0 510 761 B1 describes a method of encapsulating detergent additives in general, such as for example enzymes, bleaching activators, bleaching catalysts and bleaching agents, also including PAP, a wax being used as a protective coating for encapsulation, the melting point of which is between 40° C. and 50° C. The wax-coated particles are in this case produced by spraying on the molten wax. In this case, the wax has initially to be heated to temperatures above its melting point, which may be a disadvantage with regard to thermally sensitive substances requiring encapsulation. This method has the additional disadvantage that the active substance is only released at temperatures above the melting point of the wax used, i.e. only above temperatures of between 40° C. and 50° C., which in particular does not meet current consumer or user requirements, since, in the light of the development of more efficient detergent and cleaning agent formulations and savings in energy costs, it is frequently desired to carry out washing at even lower temperatures, in particular at around 30° C. Furthermore, a wax with a high melting point has the disadvantage that it causes residues to remain on laundry, in particular at low temperatures, since it is not fully emulsified at such temperatures.

European patent EP 0 653 485 B1 relates to active ingredient-containing capsule compositions, which may contain bleaching agents such as for example PAP and in which the active ingredient is present inside the capsule as a dispersion in oil. The production of these capsules, whose shell is formed of hydrophilic polymers which only become soluble during the washing process or use, requires a complex emulsifying process which is technologically not straightforward to perform.

Bleaching agent granules are known from European patent application EP 0 816 481 A2 which contain a peracid such as for example PAP and an agglomeration aid in the ratio by weight of 1:2 to 1:50 and citric acid monohydrate as the exotherm control active ingredient. European patent EP 0 695 343 B1 relates to amidoperoxycarboxylic acid particles, which have been spray-coated in a fluidized bed with a coating of water-soluble salt and contain less than 2 wt. % water.

DESCRIPTION OF THE INVENTION

Against this background, the object of the present invention is thus to provide peroxy compounds, also including imidoperoxycarboxylic acids, in particular phthalimidoperoxycaproic acid (PAP), in the form of storage stable particles using the simplest possible method.

This object is achieved by a method of producing bleaching agent granules which is characterized in that a particulate peroxy compound and an ionotropically crosslinkable water-soluble polymer are granulated with the assistance of a hydrous liquid binder to yield primary granules and the primary granules are contacted with a crosslinking agent for the ionotropically crosslinkable water-soluble polymer.

Suitable peroxy compounds are both those of an inorganic nature, such as alkali metal perborates, percarbonates and/or persulfates, and those of an organic nature, such as diacyl peroxides, peroxocarboxylic acids and/or the salts thereof. Peroxocarboxylic acids include amido- and imidoperoxocarboxylic acids. A preferred imidoperoxocarboxylic acid is phthalimidoperoxycaproic acid. This is known for example from European patents EP 0 349 940 and EP 0 325 328. It is commercially available in hydrous form, for example under the trade name Eureco®, as it is normally obtained when produced from aqueous systems in relatively large crystals, which may agglomerate. It may serve in this form or in any other particulate form, for example as a finely ground powder, as the starting material for the method according to the invention. As a result of production, subordinate quantities of the corresponding imidocarboxylic acid may also be contained in the imidoperoxycarboxylic acid used, which quantities do not have to be removed to carry out the method according to the invention.

Diacyl peroxides are compounds of the general formula R'—C(O)—O—O—C(O)—R", in which R' and R" denote organic residues. Preferably the diacyl peroxide is aliphatic, with R' and R" mutually independently in each case denoting an alkyl group with 8 to 20 carbon atoms. Preferably the diacyl peroxide has a melting point of more than 40° C. Particularly preferred diacyl peroxides are di-n-decanoyl peroxide (R'=R"=n-nonyl), di-n-undecanoyl peroxide (R'=R"=n-decyl) or dilauroyl peroxide (R'=R"=n-undecyl) and mixtures thereof.

If desired, the peroxy compound may also be used in admixture with conventional stabilizers or desensitizing agents, such as boric acid, citric acid and/or alkali metal citrates. Quantities of peroxy compound, in particular imidoperoxycarboxylic acid, of up to 95 wt. %, in particular 50 wt. % to 80 wt. %, in each case relative to the total particle, are preferred.

The binder is preferably selected from water and a blend thereof with inorganic salts, nonionic surfactants, anionic surfactants, polymeric glycols, polymers and copolymers of acrylic acid, methacrylic acid and/or maleic acid, which may also be present in the form of their sodium, potassium or ammonium salts, and mixtures thereof. Suitable inorganic salts are in particular those whose presence influences granule strength or hardness, such as for example alkali metal silicate. The binder, if not solely water, is preferably used as an aqueous solution, which in particular has a water content of 30 wt. % to 99 wt. %.

In a preferred embodiment of the invention, the hydrous binder, optionally consisting solely of water, is dispensed into the mixer as a constituent of a preparation containing the particulate peroxy compound and/or of a preparation containing the ionotropically crosslinkable polymer. To implement the first-mentioned variant, which is preferably used when processing sparingly water-soluble or water-insoluble peroxy compounds, the use of a conventional commercial hydrous imidoperoxycarboxylic acid is suitable, for example. If desired, the binder may also contain the ionotropically crosslinkable polymer or an aqueous solution of the crosslinkable polymer may constitute the binder.

The binder or the preparation consisting of binder and crosslinkable polymer is preferably sprayed onto the moving material (peroxy compound and crosslinkable polymer or solely peroxy compound) by means of nozzles. Spraying may be effected by means of single fluid or high pressure spray nozzles, two-fluid nozzles or three-fluid nozzles. For spraying with single fluid spray nozzles it is necessary to apply an elevated pressure to the medium being sprayed, while spraying with two-fluid spray nozzles proceeds with the assistance of a compressed air stream. Spraying with two-fluid spray nozzles is more favorable particularly with regard to possible nozzle blockages, but is more complex due to the elevated consumption of compressed air. As a modern further development, three-fluid spray nozzles are available, which in addition to the compressed air stream comprise a further air conveying system for atomization purposes, which is intended to prevent blockages and droplet formation at the nozzle. For the purposes of the method according to the invention, the use of two-fluid spray nozzles is particularly preferred. Preferably, the liquid components are sprayed as uniformly as possible onto the particulate material.

In the method according to the invention, any low, medium or high shear mixers known to a person skilled in the art may be used. Suitable mixers are free-fall mixers, thrust and turbulent mixers, gravity mixers and pneumatic mixers. Preferred free-fall mixers are drum, tumbling, cone, double cone and V-type mixers. Thrust mixer is the term used for mixers with moving mixing tools, in which the mixing tools move at low speed. Examples of suitable mixers are screw mixers and helical ribbon blenders. High-speed mixers with moving mixing tools are known as turbulent mixers and comprise for example paddle, ploughshare, blade and ribbon mixers. Suitable mixers with a moving container and moving mixing tools are preferably pan mixers and counterflow intensive mixers. Suitable gravity mixers are inter alia mixing silos, hoppers or also belts. Suitable pneumatic mixers are again mixing silos, fluidized bed mixers and jet mixers.

The method according to the invention is carried out particularly preferably in a turbulent mixer, in particular a ploughshare mixer, or a pneumatic fluidized bed. When using a fluidized bed mixer it is particularly advantageous that a desired degree of drying of the granules may be established without additional apparatus. If other mixer types are used, the primary granules and/or the finished granules may, if desired, be transferred into a fluidized bed drier and adjusted with the assistance thereof to a degree of drying not achieved by the granulation process proper.

If desired, the granulation resulting in the primary granules may also be carried out by a compacting step. The compacting step is preferably performed with the assistance of a roll press or of an extruder. In this case, such pressures are preferably applied that the resultant granules have a bulk density in the range from 600 g/l to 1500 g/l, in particular 750 g/l to 1200 g/l.

The primary granules are then contacted with a crosslinking agent, which may crosslink the ionotropically crosslinkable polymer. This may take place through addition of the crosslinking agent to the primary granules located in a mixer or a fluidized bed, in which granulation has optionally already taken place, the crosslinking agent preferably being introduced as an aqueous solution, or the primary granules are introduced into an aqueous solution of the crosslinking agent, then removed again therefrom, for example by filtering out, and if desired dried.

It is preferable for the ionotropically crosslinkable polymer to be selected from a material from the group comprising carrageenan, alginate, gellan gum and pectic acid and mixtures thereof. Na alginate is particularly preferred.

Alginate is a naturally occurring salt of alginic acid and occurs in brown algae (Phaeophycea) as a cell wall constituent. Alginates are acidic polysaccharides containing carboxy-groups and having a relative molecular weight MR of approx. 200,000, consisting of D-mannuronic acid and L-guluronic acid in different ratios, which are linked together by way of 1,4-glycosidic bonds. Sodium, potassium, ammonium and magnesium alginates are readily water-soluble. The viscosity of alginate solutions depends inter alia on the molar mass and on the counterion. At given quantity ratios, calcium alginates form thermoirreversible gels. Sodium alginates result in highly viscous solutions with water and may be crosslinked by interaction with di- or trivalent metal ions such as $Ca^{2+}$.

Carrageenan is an extract from red algae belonging to the Florideae (*Chondrus crispus* and *Gigartina stellata*). Carrageenan crosslinks in the presence of $K^+$ ions or $Ca^{2+}$ ions.

Gellan gum is an unbranched anionic microbial heteroexopolysaccharide with a tetrasaccharide repeating unit, consisting of the monomers glucose, glucuronic acid and rhamnose, each repeating unit being esterified for instance with an L-glycerate and every second repeating unit being esterified with an acetate. Gellan gum crosslinks in the presence of $K^+$ ions, $Na^+$ ions, $Ca^{2+}$ ions or $Mg^{2+}$ ions.

When pectin is exposed to alkalis or pectinase, pectosinic acid arises, followed by pectic acid. The basic building block of pectic acid is poly-D-galacturonic acid. Pectic acid forms a colorless mass barely soluble in cold water, sparingly soluble in hot water, insoluble in alcohol and readily soluble in solutions of neutral salts; it exhibits an acid reaction and flavor and forms gelatinous salts which are soluble with the alkalis but otherwise insoluble. Pectic acid may be crosslinked by interaction with di- or trivalent metal ions; insoluble calcium pectate arises through the addition of calcium ions onto the galacturonic acid units.

These materials may be crosslinked particularly well with aqueous solutions of the stated cations to yield crosslinked insoluble gels; preferably no halides are present therein as counteranions, but rather for example nitrate, sulfate and/or phosphate.

For aesthetic reasons it may be desirable for the granules to be colored. To this end, the granules may contain one or more coloring agent(s) such as a pigment or dye. Preferably, this stems from an aqueous crosslinking agent solution which for this purpose contains an in particular phthalocyanine-based pigment or dye.

The particle size of the granules obtainable by the method according to the invention preferably lies in the range from 1 to 3 mm.

If desired, the granules obtainable in this way may additionally be coated with a coating material, preferably a coating of paraffin wax. Paraffin wax is generally a complex substance mixture without a sharp melting point. For characterization, its melting range, and/or its solidification point, is conventionally determined by differential thermal analysis (DTA), as described in "The Analyst" 87 (1962), 420. Solidification point is understood to mean the temperature at which molten material changes from the liquid into the solid state by slow cooling. Waxes are preferably used which solidify in the range from 20° C. to 70° C. It should be noted in this respect that apparently solid paraffin wax mixtures may contain variable proportions of liquid paraffin even at room temperature. Particularly preferred paraffin wax mixtures have a liquid content of at least 50 wt. %, in particular of 55 wt. % to 80 wt. %, at 40° C. and a liquid content of at least 90 wt. % at 60° C. It is additionally preferable for the paraffins to contain as little as possible in the way of volatile fractions. Preferred paraffin waxes contain less than 1 wt. % of vaporizable fractions, in particular less than 0.5 wt. % at 110° C. and standard pressure. Paraffin waxes which are particularly useful according to the invention may be obtained for example under the trade names Lunaflex® from Fuller and Deawax® from DEA Mineralöl AG. Particularly preferred paraffin waxes include those which melt in the range from 40° C. to 65° C., in particular from 50° C. to 60° C.

Paraffin is preferably applied in such quantities that the coated particles consist in a proportion of 2 wt. % to 30 wt. %, in particular 5 wt. % to 25 wt. % and particularly preferably 7.5 wt. % to 20 wt. % of the coating material. Preferably, to produce coated particles a fluidized bed of the particles to be coated is sprayed with a melt or optionally a preferably aqueous emulsion, dispersion or suspension of the paraffin, water, if present, is removed by vaporization and/or the molten coating material is solidified by cooling and the coated particles are discharged from the fluidized bed in the in principle conventional manner. When coating with paraffin wax, a melt coating, in which the paraffin is at a temperature 5° C. to 40° C. above its melting point, is preferably heated and applied to particles which are at a temperature below the paraffin solidification point. Preferably, they are cooled by the fluidizing agent, which is then at a correspondingly low temperature, such that the paraffin wax solidifies on the particles.

Particles obtainable by the method according to the invention are preferably used as bleaching agents or bleaching agent components, in particular in detergents and cleaning agents, and for the production thereof. Detergents or cleaning agents according to the invention contain granules according to the invention preferably in quantities of from 0.1 wt. % to 25 wt. %, in particular 1 wt. % to 10 wt. %, and may in addition contain any further ingredients conventional in such agents. Solid agents according to the invention preferably have a bulk density in the range from 400 g/l to 1000 g/l.

It is particularly advantageous that the granules according to the invention may also be used in hydrous liquid agents. The present invention accordingly also provides an aqueous liquid detergent or cleaning agent containing surfactant and bleaching agent granules obtainable by the method according to the invention.

In addition to the granules according to the invention, the detergents or cleaning agents contain surfactant(s), it being possible to use anionic, nonionic, cationic and/or amphoteric surfactants. From an applicational standpoint mixtures of anionic and nonionic surfactants are preferred. The total surfactant content of the liquid detergent and cleaning agent is preferably below 40 wt. % and particularly preferably below 35 wt. %, relative to the total liquid detergent and cleaning agent. It preferably contains at least one additional active ingredient, which is not a constituent of the granules, selected from the group comprising optical brighteners, complexing agents, bleaching activators, dyes, fragrances, antioxidants, builders, enzymes, enzyme stabilizers, antimicrobial active ingredients, graying inhibitors, antiredeposition agents, pH adjusting agents, soil release polymers, color transfer inhibitors, electrolytes, conditioning oils, abrasives, skincare agents, foam inhibitors, vitamins, proteins, preservatives, detergency boosters, pearlescent agents, and UV absorbers as well as mixtures thereof.

Alkoxylated, advantageously ethoxylated, in particular primary alcohols with preferably 8 to 18 C atoms and on average 1 to 12 mol of ethylene oxide (EO) per mol of alcohol, in which the alcohol residue may be linear or preferably methyl-branched in position 2 or may contain linear and methyl-branched residues in the mixture, as are usually present in oxo alcohol residues, are preferably used as nonionic surfactants. In particular, however, alcohol ethoxylates with linear residues prepared from alcohols of natural origin with 12 to 18 C atoms, for example from coconut, palm, tallow fat or oleyl alcohol, and on average 2 to 8 EO per mol of alcohol are preferred. Preferred ethoxylated alcohols include, for example, $C_{12-14}$ alcohols with 3 EO, 4 EO or 7 EO, $C_{9-11}$ alcohols with 7 EO, $C_{13-15}$ alcohols with 3 EO, 5 EO, 7 EO or 8 EO, $C_{12-18}$ alcohols with 3 EO, 5 EO or 7 EO and mixtures of these, such as mixtures of $C_{12-14}$ alcohols with 3 EO and $C_{12-18}$ alcohols with 7 EO. The stated degrees of ethoxylation are statistical averages which, for a specific product, may be an integer or a fractional number. Preferred alcohol ethoxylates have a narrow homolog distribution (narrow range ethoxylates, NRE). In addition to these nonionic surfactants, fatty alcohols with more than 12 EO may also be used. Examples of these are tallow fatty alcohol with 14 EO, 25 EO, 30 EO or 40 EO. Nonionic surfactants containing EO and PO groups together in one molecule may also be used according to the invention. In this respect it is possible to use block copolymers with EO-PO block units or PO-EO block units, or also EO-PO-EO copolymers or PO-EO-PO copolymers. It goes without saying that mixed alkoxylated nonionic surfactants may also be used, in which EO and PO units are not distributed in blocks but rather randomly. Such products are obtainable by simultaneous action of ethylene and propylene oxide on fatty alcohols.

Alkyl glycosides of the general formula $RO(G)_x$, in which R means a primary straight-chain or methyl-branched aliphatic residue, in particular methyl-branched in position 2, with 8 to 22, preferably 12 to 18 C atoms and G is the symbol which denotes a glycose unit with 5 or 6 C atoms, preferably glucose, may moreover also be used as further nonionic surfactants. The degree of oligomerization x, which indicates the distribution of monoglycosides and oligoglycosides, is any desired number between 1 and 10; x is preferably 1.2 to 1.4.

A further class of preferably used nonionic surfactants, which may be used either as sole nonionic surfactant or in combination with other nonionic surfactants, are alkoxylated, preferably ethoxylated or ethoxylated and propoxylated fatty acid alkyl esters, preferably with 1 to 4 carbon atoms in the alkyl chain, in particular fatty acid methyl esters.

Nonionic surfactants of the amine oxide type, for example N-coconut alkyl-N,N-dimethylamine oxide and N-tallow alcohol-N,N-dihydroxyethylamine oxide, and the fatty acid alkanolamide type may also be suitable. The quantity of these nonionic surfactants preferably amounts to no more than that of the ethoxylated fatty alcohols, in particular no more than half the quantity thereof.

Further suitable surfactants are polyhydroxyfatty acid amides of the formula (2),

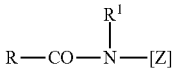

(2)

in which RCO denotes an aliphatic acyl residue with 6 to 22 carbon atoms, $R^1$ denotes hydrogen, an alkyl or hydroxyalkyl residue with 1 to 4 carbon atoms and [Z] denotes a linear or branched polyhydroxyalkyl residue with 3 to 10 carbon atoms and 3 to 10 hydroxyl groups. The polyhydroxyfatty acid amides comprise known substances which may conventionally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds of the formula (3),

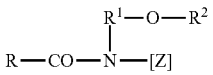

(3)

in which R denotes a linear or branched alkyl or alkenyl residue with 7 to 12 carbon atoms, $R^1$ denotes a linear, branched or cyclic alkyl residue or an aryl residue with 2 to 8 carbon atoms and $R^2$ denotes a linear, branched or cyclic alkyl residue or an aryl residue or an oxyalkyl residue with 1 to 8 carbon atoms, wherein $C_{1-4}$ alkyl or phenyl residues are preferred, and [Z] denotes a linear polyhydroxyalkyl residue, the alkyl chain of which is substituted with at least two hydroxyl groups, or alkoxylated, preferably ethoxylated or propoxylated derivatives of this residue.

[Z] is preferably obtained by reductive amination of a sugar, for example glucose, fructose, maltose, lactose, galactose, mannose or xylose. The N-alkoxy- or N-aryloxy-substituted compounds may then be converted into the desired polyhydroxyfatty acid amides by reaction with fatty acid methyl esters in the presence of an alkoxide as catalyst.

The content of nonionic surfactants in the liquid detergents and cleaning agents preferably amounts to 5 to 30 wt. %, preferably 7 to 20 wt. % and in particular 9 to 15 wt %, in each case relative to the total agent.

The anionic surfactants used may for example be those of the sulfonate and sulfate type. Surfactants of the sulfonate type which may here preferably be considered are $C_{9-13}$ alkyl benzene sulfonates, olefin sulfonates, i.e. mixtures of alkene and hydroxyalkane sulfonates and disulfonates, as are obtained, for example, from $C_{12-18}$ monoolefins with a terminal or internal double bond by sulfonation with gaseous sulfur trioxide and subsequent alkaline or acidic hydrolysis of the sulfonation products. Alkane sulfonates which are obtained from $C_{12-18}$ alkanes for example by sulfochlorination or sulfoxidation with subsequent hydrolysis or neutralization are also suitable. Likewise, the esters of α-sulfofatty acids (ester sulfonates) are also suitable, for example the α-sulfonated methyl esters of hydrogenated coconut, palm kernel or tallow fatty acids.

Further suitable anionic surfactants are sulfated fatty acid glycerol esters. Fatty acid glycerol esters are understood to mean mono-, di- and triesters and mixtures thereof, as are obtained during production by esterification of a monoglycerol with 1 to 3 mol of fatty acid or on transesterification of triglycerides with 0.3 to 2 mol of glycerol. Preferred sulfated fatty acid glycerol esters are here the sulfated products of saturated fatty acids with 6 to 22 carbon atoms, for example caproic acid, caprylic acid, capric acid, myristic acid, lauric acid, palmitic acid, stearic acid or behenic acid.

Preferred alk(en)yl sulfates are the alkali metal and in particular sodium salts of sulfuric acid semi-esters of $C_{12}$-$C_{18}$ fatty alcohols for example prepared from coconut fatty alcohol, tallow fatty alcohol, lauryl, myristyl, cetyl or stearyl alcohol or $C_{10}$-$C_{20}$ oxo alcohols and those semi-esters of secondary alcohols of these chain lengths. Alk(en)yl sulfates of the stated chain length which contain a synthetic straight-chain alkyl residue produced on a petrochemical basis and which exhibit degradation behavior similar to that of the appropriate compounds based on fatty chemical raw materials are also preferred. $C_{12}$-$C_{16}$ alkyl sulfates and $C_{12}$-$C_{15}$ alkyl sulfates and $C_{14}$-$C_{15}$ alkyl sulfates are preferred because of their washing characteristics. 2,3-Alkyl sulfates, which may be obtained as commercial products from Shell Oil Company under the name DAN®, are suitable anionic surfactants.

The sulfuric acid monoesters of straight-chain or branched $C_{7-21}$ alcohols ethoxylated with 1 to 6 mol of ethylene oxide are also suitable, such as 2-methyl-branched $C_{9-11}$ alcohols with on average 3.5 mol of ethylene oxide (EO) or $C_{12-18}$ fatty alcohols with 1 to 4 EO. Due to their strong foaming behavior, they are used in cleaning agents in only relatively small quantities, for example in quantities of 1 to 5 wt. %.

Further suitable anionic surfactants are the salts of alkylsulfosuccinic acid, which are also known as sulfosuccinates or sulfosuccinic acid esters, and are the monoesters and/or diesters of sulfosuccinic acid with alcohols, preferably fatty alcohols and in particular ethoxylated fatty alcohols. Preferred sulfosuccinates contain $C_{8-18}$ fatty alcohol residues or mixtures thereof. Particularly preferred sulfosuccinates contain a fatty alcohol residue which is derived from ethoxylated fatty alcohols, which are in themselves nonionic surfactants. Sulfosuccinates whose fatty alcohol residues are derived from ethoxylated fatty alcohols with a narrow homolog distribution are here particularly preferred. It is likewise also possible to use alk(en)ylsuccinic acid with preferably 8 to 18 carbon atoms in the alk(en)yl chain or the salts thereof.

Particularly preferred anionic surfactants are soaps. Saturated and unsaturated fatty acid soaps are in particular suitable, such as the salts of lauric acid, myristic acid, palmitic acid, stearic acid, hydrogenated erucic acid and behenic acid and in particular soap mixtures derived from natural fatty acids, for example coconut, palm kernel, olive oil or tallow fatty acids.

The anionic surfactants, including the soaps, may be present in the form of the sodium, potassium or ammonium salts thereof and as soluble salts of organic bases, such as mono-, di- or triethanolamine. The anionic surfactants are preferably present in the form of the sodium or potassium salts thereof, in particular in the form of the sodium salts.

The content of anionic surfactants in the preferred liquid detergents and cleaning agents amounts to 2 to 30 wt. %, preferably 4 to 25 wt. % and in particular 5 to 22 wt %, in each case relative to the total agent.

The viscosity of the liquid detergent or cleaning agent may be measured with conventional standard methods (for example Brookfield viscosimeter LVT-II at 20 rpm and 20° C., spindle 3) and is preferably in the range from 500 to 5000 mPa·s. Preferred agents have viscosities of from 700 to 4000 mPa·s, values of between 1000 and 3000 mPa·s being particularly preferred.

In addition to the granules and the surfactant(s), the detergents or cleaning agents may contain further ingredients, which further improve the applicational and/or aesthetic properties of the liquid detergent and cleaning agent. For the purposes of the present invention, preferred agents contain, in addition to the capsules and to the surfactant(s), one or more substances from the group comprising builders, bleaching activators, enzymes, electrolytes, nonaqueous solvents, pH adjusting agents, fragrances, perfume carriers, fluorescent agents, dyes, hydrotropes, foam inhibitors, silicone oils, antiredeposition agents, optical brighteners, graying inhibitors, shrinkage prevention agents, anti-crease agents, color transfer inhibitors, antimicrobial active ingredients, germicides, fungicides, antioxidants, corrosion inhibitors, antistatic agents, ironing aids, waterproofing and impregnation agents, anti-swelling and anti-slip agents and UV absorbers. If the capsules essential to the invention contain a strongly active oxidizing agent such as for example PAP, it is possible to dispense with bleaching activators and antimicrobial active ingredients, germicides and fungicides.

Possible builders, which may be contained in the detergents or cleaning agents, are in particular silicates, aluminum silicates (in particular zeolites), carbonates, salts of organic di- and polycarboxylic acids and mixtures of these substances.

Suitable crystalline, layered sodium silicates have the general formula $NaMSi_xO_{2x+1}H_2O$, M meaning sodium or hydrogen, x being a number from 1.9 to 4 and y a number from 0 to 20 and preferred values for x being 2, 3 or 4. Preferred crystalline phyllosilicates of the stated formula are those in which M denotes sodium and x assumes the values 2 or 3. In particular, both β- and δ-sodium disilicates $Na_2Si_2O_5.yH_2O$ are preferred.

Amorphous sodium silicates may also be used which have an $Na_2O:SiO_2$ modulus of 1:2 to 1:3.3, preferably of 1:2 to 1:2.8 and in particular of 1:2 to 1:2.6, which are dissolution-retarded and exhibit secondary washing characteristics. Dissolution retardation relative to conventional amorphous sodium silicates may here have been achieved in various ways, for example by surface treatment, compounding, compaction/compression or by overdrying. For the purposes of the present invention, the term "amorphous" should also be taken to mean "X-ray amorphous". This means that, in X-ray diffraction experiments, the silicates do not provide any sharp X-ray reflections, as are typical of crystalline substances, but at most one or more maxima of the scattered X-radiation, which have a width of two or more graduations of the diffraction angle. However, particularly good builder characteristics may very well be obtained if, in X-ray diffraction experiments, the silicate particles yield blurred or even sharp diffraction maxima. This should be interpreted to mean that the products comprise microcrystalline domains of a size of 10 to several hundred nm, values of up to at most 50 nm and in particular of up to at most 20 nm being preferred. Compressed/compacted amorphous silicates, compounded amorphous silicates, and overdried, X-ray amorphous silicates are particularly preferred.

The finely crystalline, synthetic zeolite containing bound water is preferably zeolite A and/or P. Zeolite MAP® (commercial product from Crosfield) is particularly preferred as zeolite P. However, zeolite X and mixtures of A, X and/or P are also suitable. A co-crystalline product of zeolite X and zeolite A (approx. 80 wt. % zeolite X), which is distributed by SASOL under the trade name VEGOBOND AX® and may be described by the formula $$n\mathrm{Na_2O}\cdot(1-n)\mathrm{K_2O}\cdot\mathrm{Al_2O_3}\cdot(2\text{-}2.5)\mathrm{SiO_2}\cdot(3.5\text{-}5.5)\mathrm{H_2O}$$

n=0.90-1.0 is commercially obtainable and preferably usable for the purposes of the present invention. The zeolite may be used as a spray-dried powder or also as an undried, stabilized suspension which is still moist from the production thereof. In the event that the zeolite is used as a suspension, said suspension may contain small added quantities of nonionic surfactants as stabilizers, for example 1 to 3 wt. %, relative to the zeolite, of ethoxylated $C_{12}$-$C_{18}$ fatty alcohols with 2 to 5 ethylene oxide groups, $C_{12}$-$C_{14}$ fatty alcohols with 4 to 5 ethylene oxide groups or ethoxylated isotridecanols. Suitable zeolites have an average particle size of less than 10 μm (volume distribution; measurement method: Coulter Counter) and preferably contain 18 to 22 wt. %, in particular 20 to 22 wt. %, of bound water.

Generally known phosphates may, of course, also be used as builder substances, provided that such use should not be avoided on environmental grounds. The sodium salts of orthophosphates, pyrophosphates and in particular of tripolyphosphates are particularly suitable.

Bleaching activators may be incorporated into the detergents and cleaning agents in order to achieve improved bleaching action of compounds which release $H_2O_2$ in water when washing at temperatures of 60° C. and below. Bleaching activators which may be used are compounds which, under perhydrolysis conditions, yield aliphatic peroxycarboxylic acids with preferably 1 to 10 C atoms, in particular 2 to 4 C atoms, and/or optionally substituted perbenzoic acid. Suitable substances are those which bear O- and/or N-acyl groups having the stated number of C atoms and/or optionally substituted benzoyl groups. Preferred compounds are repeatedly acylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoyl succinimide (NOSI), acylated phenolsulfonates, in particular n-nonanoyl or isononanoyl oxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran.

In addition to, or instead of, conventional bleaching activators, it is also possible to incorporate "bleach catalysts" into the detergents and cleaning agents. These substances comprise bleach-boosting transition metal salts or transition metal complexes such as for example Mn, Fe, Co, Ru or Mo salen complexes or carbonyl complexes. Mn, Fe, Co, Ru, Mo, Ti, V and Cu complexes with nitrogenous tripod ligands and Co, Fe, Cu and Ru amine complexes may also be used as bleach catalysts.

A liquid detergent or cleaning agent according to the invention preferably contains a thickener. The thickener may for example comprise a polyacrylate thickener, xanthan gum, gellan gum, guar flour, alginate, carrageenan, carboxymethylcellulose, bentonites, welan gum, locust bean flour, agar-agar, tragacanth, gum arabic, pectins, polyoses, starch, dextrins, gelatine and casein.

However, electrolytes or modified natural materials such as modified starches and celluloses, for example carboxymethylcellulose and other cellulose ethers, hydroxyethyl and hydroxypropyl cellulose and seed flour ethers, may also be used as thickeners.

The polyacrylic and polymethacrylic thickeners include, for example, the high molecular weight homopolymers, crosslinked with a polyalkenyl polyether, in particular an allyl ether of sucrose, pentaerythritol or propylene, of acrylic acid (INCI name according to the "International Dictionary of Cosmetic Ingredients" of "The Cosmetic, Toiletry, and Fragrance Association (CTFA)": Carbomer), which are also known as carboxyvinyl polymers. Such polyacrylic acids are obtainable inter alia from 3V Sigma under the trade name Polygel®, e.g. Polygel DA, and from B.F. Goodrich under the trade name Carbopol®, for example Carbopol 940 (molecular weight approx. 4,000,000), Carbopol 941 (molecular weight approx. 1,250,000) or Carbopol 934 (molecular weight approx. 3,000,000). They furthermore include the following acrylic acid copolymers: (i) copolymers of two or more monomers from the group of acrylic acid, methacrylic acid and the simple esters thereof, preferably formed with $C_{1-4}$ alkanols (INCI Acrylates Copolymer), which include for instance the copolymers of methacrylic acid, butyl acrylate and methyl methacrylate (CAS name according to Chemical Abstracts Service: 25035-69-2) or of butyl acrylate and methyl methacrylate (CAS 25852-37-3) and which are obtainable for example from Rohm & Haas under the trade names Aculyn® and Acusol® and from: Degussa (Goldschmidt) under the trade name Tego® Polymer, for example the anionic non-associative polymers Aculyn 22, Aculyn 28, Aculyn 33 (crosslinked), Acusol 810, Acusol 820, Acusol 823 and Acusol 830 (CAS 25852-37-3); (ii) crosslinked high molecular weight acrylic acid copolymers, which include for instance the copolymers, crosslinked with an allyl ether of sucrose or of pentaerythritol, of $C_{10-30}$ alkyl acrylates with one or more monomers from the group of acrylic acid, methacrylic acid and the simple esters thereof, preferably formed with $C_{1-4}$ alkanols (INCI Acrylates/$C_{10-30}$ Alkyl Acrylate Crosspolymer) and which are obtainable for example from B.F. Goodrich under the trade name Carbopol®, for example hydrophobized Carbopol ETD 2623 and Carbopol 1382 (INCI Acrylates/$C_{10-30}$ Alkyl Acrylate Crosspolymer) and Carbopol Aqua 30 (formerly Carbopol EX 473).

A further polymeric thickener which may preferably be used is xanthan gum, a microbial anionic heteropolysaccharide, which is produced from *Xanthomonas campestris* and certain other species under aerobic conditions and has a molar mass of 2 to 15 million daltons. Xanthan is formed from a chain with β-1,4-linked glucose (cellulose) with side chains. The structure of the subgroups consists of glucose, mannose, glucuronic acid, acetate and pyruvate, the number of pyruvate units determining the viscosity of the xanthan gum.

Xanthan gum may be described by the following formula (1):

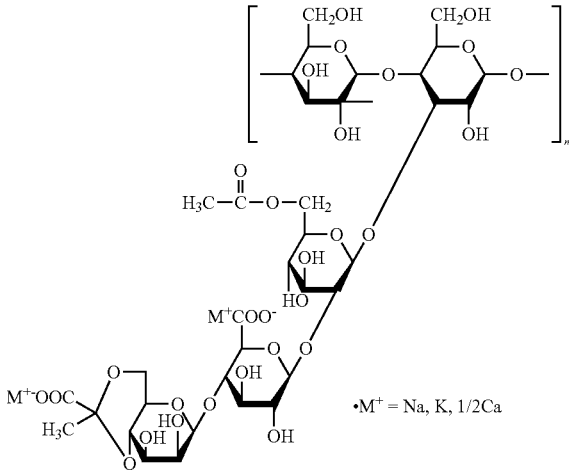

Xanthan repeating unit

Xanthan gum is obtainable for example from Kelco under the trade names Keltrol® and Kelzan® or also from Rhodia under the trade name Rhodopol®.

Preferred aqueous liquid detergents or cleaning agents contain 0.01 to 3 wt. % and preferably 0.1 to 1 wt. % of thickener relative to the total agent. The quantity of thickener used is here dependent on the type of thickener and the desired degree of thickening.

The aqueous liquid detergent or cleaning agents may contain enzymes, optionally in coated or encapsulated form. Enzymes which may in particular be considered are those from the classes of hydrolases such as proteases, esterases, lipases or lipolytically active enzymes, amylases, cellulases or other glycosylhydrolases and mixtures of the stated enzymes. In laundry, all these hydrolases contribute to the removal of stains such as those containing protein, fat or starch and of graying. By removing pilling and microfibrils, cellulases and other glycosylhydrolases may furthermore contribute to color retention and to increasing textile softness. Oxyreductases may also be used to boost bleaching or to inhibit color transfer. Enzymatic active ingredients isolated from strains of bacteria or fungi such as *Bacillus subtilis, Bacillus licheniformis, Streptomyceus griseus* and *Humicola insolens* are particularly suitable. Proteases of the subtilisin type and in particular proteases isolated from *Bacillus lentus* are preferably used. Enzyme mixtures, for example of protease and amylase or protease and lipase or lipolytically active enzymes or protease and cellulase or of cellulase and lipase or lipolytically active enzymes or of protease, amylase and lipase or lipolytically active enzymes or protease, lipase or lipolytically active enzymes and cellulase, but in particular mixtures containing protease and/or lipase or mixtures with lipolytically active enzymes are of particular interest for this purpose. Examples of such lipolytically active enzymes are the known cutinases. Peroxidases or oxidases have also proved suitable in some cases. Suitable amylases include in particular α-amylases, iso-amylases, pullulanases and pectinases. Cellobiohydrolases, endoglucanases and β-glucosidases, which are also known as cellobiases, or mixtures of these are preferably used as cellulases. Since different cellulase types differ in their CMCase and Avicelase activities, desired activities may be established by purposeful mixing of the cellulases.

The enzymes may be adsorbed on support materials in order to protect them from premature breakdown. The proportion of enzymes, enzyme mixtures or enzyme granules in the detergent or cleaning agent composition may for example amount to approx 0.1 to 5 wt. %, preferably 0.12 to approx 2.5 wt. %.

A wide range of the most varied salts may be used as electrolytes from the group of inorganic salts. Preferred cations are alkali metals and alkaline earth metals; preferred anions are phosphates and sulfates. From a manufacturing standpoint, it is preferred to use $Na_2SO_4$ or $MgSO_4$ in the agents. The proportion of electrolytes in the agents amounts conventionally to 0.5 to 20 wt. %.

Non-aqueous solvents, which may be used in the liquid detergents and cleaning agents, originate for example from the group comprising mono- or polyvalent alcohols, alkanolamines or glycol ethers, provided that they are water-miscible in the stated concentration range. The solvents are preferably selected from ethanol, n- or i-propanol, butanes, glycol, propanediol or butanediol, glycerol, diglycol, diethylene glycol monobutyl or monopropyl ether, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol monomethyl or monoethyl ether, diisopropylene glycol monomethyl or monoethyl ether, methoxy-, ethoxy- or butoxytriglycol, 1-butoxyethoxy-2-propanol, 3-methyl-3-methoxybutanol, propylene glycol-t-butyl ether and mixtures of these solvents. Non-aqueous solvents may be used in the liquid detergents and cleaning agents in quantities of between 0.5 and 15 wt. %, but preferably below 12 wt. % and in particular below 9 wt. %.

To bring the pH value of the liquid detergents and cleaning agents into the desired range, the use of pH adjusting agents may be indicated. In this case, any known acids or alkalies may be used, provided that their use is not prohibited for applicational or environmental reasons or for reasons of consumer protection. Conventionally, the quantity of these adjusting agents does not exceed 7 wt. % of the total formulation. Preferably liquid agents according to the invention have an acidic pH value of in particular pH 3.5 to pH 6.5. If desired, its liquid phase may also be neutral to weakly alkaline, approx. up to pH 9.5. If desired, water may be contained in agents according to the invention in quantities of up to 90 wt. %, in particular 20 wt. % to 75 wt. %; optionally, however, the values may exceed or fall below these ranges.

To improve the aesthetic impression of the liquid detergents or cleaning agents, they may be dyed with suitable dyes. Preferred dyes, the selection of which will cause a person skilled in the art no difficulty, have elevated storage stability and are insensitive to the other ingredients of the agents and to light and have no marked substantivity relative to textile fibers, so as not to dye these. If the granules according to the invention are dyed, the liquid phase of the agent preferably has a different color or a different color shade.

Examples of suitable foam inhibitors which may be used in liquid detergents and cleaning agents are soaps, paraffins or silicone oils, which may optionally be applied to support materials.

Suitable soil release polymers, which are also known as antiredeposition agents, include, for example, nonionic cellulose ethers such as methylcellulose and methylhydroxypropylcellulose with a content of methoxy groups of 15 to 30 wt. % and of hydroxypropoxyl groups of 1 to 15 wt. %, in each case relative to the nonionic cellulose ethers, as well as the polymers known from the prior art of phthalic acid and/or terephthalic acid or of the derivatives thereof, in particular polymers prepared from ethylene terephthalates and/or polyethylene glycol terephthalates or anionically and/or nonionically modified derivatives of these. The sulfonated derivatives of phthalic acid and terephthalic acid polymers are suitable derivatives.

Optical brighteners may be added to the liquid detergents and cleaning agents in order to eliminate graying and yellowing of the treated textile fabric. These substances become attached to the fibers and bring about a lightening and simulated bleaching action, by transforming invisible ultraviolet radiation into visible, longer-wave light, the ultraviolet light absorbed from sunlight being radiated as weakly bluish fluorescence and resulting, in combination with the yellow shade of the grayed or yellowed laundry, in pure white. Suitable compounds are obtained for example from the substance classes comprising 4,4'-diamino-2,2'-stilbene disulfonic acids (flavone acids), 4,4'-distyryl biphenylene, methylumbelliferones, coumarins, dihydroquinolinones, 1,3-diaryl pyrazolines, naphthalic acid imides, benzoxazole, benzisoxazole and benzimidazole systems and the pyrene derivatives substituted by heterocycles. The optical brighteners are conventionally used in quantities of between 0.03 and 0.3 wt. %, relative to the finished agent.

Graying inhibitors have the task of keeping soiling which has been dissolved off the fibers in suspension in the liquor, so preventing redeposition of the soiling. Water-soluble colloids of a mainly organic nature are suitable for this purpose, for example size, gelatin, salts of ether sulfonic acids of starch or cellulose or salts of acidic sulfuric acid esters of cellulose or starch. Water-soluble polyamides containing acidic groups are also suitable for this purpose. Soluble starch preparations and starch products other than those mentioned above may furthermore be used, for example degraded starch, aldehyde starches etc. Polyvinylpyrrolidone may also be used. However, cellulose ethers, such as carboxymethylcellulose (Na salt), methylcellulose, hydroxyalkylcellulose and mixed ethers, such as methylhydroxyethylcellulose, methylhydroxypropylcellulose, methylcarboxymethylcellulose and mixtures thereof, are preferably used, in quantities of 0.1 to 5 wt. % relative to the agents.

Since textile fabrics, in particular of rayon, viscose staple fiber, cotton and mixtures thereof, may have a tendency to crease, because the individual fibers are sensitive to bending, folding, pressing and squeezing transversely of the fiber direction, the agents may contain synthetic anti-crease agents. These include for example synthetic products based on fatty acids, fatty acid esters, fatty acid amides, fatty acid alkylol esters, fatty acid alkylol amides or fatty alcohols, which have generally been reacted with ethylene oxide, or products based on lecithin or modified phosphoric acid ester.

The liquid detergents and cleaning agents may contain antimicrobial active ingredients in order to combat microorganisms. In this connection, a distinction is drawn, depending on the antimicrobial spectrum and mechanism of action, between bacteriostatics and bactericides, fungistatics and fungicides etc. Significant substances from these groups are, for example, benzalkonium chlorides, alkylarylsulfonates, halophenols and phenol mercuriacetate, it also being possible to omit these compounds completely from the agents according to the invention.

The agents may contain antioxidants in the liquid phase in order to prevent unwanted changes to the liquid detergents and cleaning agents and/or to the treated textile fabrics brought about by the action of oxygen and other oxidative processes. This class of compounds includes, for example, substituted phenols, hydroquinones, pyrocatechols and aromatic amines as well as organic sulfides, polysulfides, dithiocarbamates, phosphites and phosphonates.

Increased wearing comfort may result from the additional use of antistatic agents, which are additionally added to the agents. Antistatic agents increase surface conductivity and thus enable improved dissipation of charges formed. External antistatic agents are as a rule substances with at least one hydrophilic molecule ligand and produce a more or less hygroscopic film on the surfaces. These generally interfacially active antistatic agents may be subdivided into nitrogenous (amines, amides, quaternary ammonium compounds), phosphorus-containing (phosphoric acid esters) and sulfur-containing (alkyl sulfonates, alkyl sulfates) antistatic agents. Lauryl (or stearyl) dimethyl benzyl ammonium chlorides are suitable as antistatic agents for textile fabrics or as an additive for detergents, a finishing effect additionally being achieved.

To improve the water absorption capacity or rewettability of the treated textile fabrics and to simplify ironing of the treated textile fabrics, silicone derivatives may for example be used in the liquid detergents and cleaning agents. These additionally improve rinsing out of the agents due to their foam-inhibiting properties. Preferred silicone derivatives are for example polydialkyl- or alkylarylsiloxanes, in which the alkyl groups comprise one to five C atoms and are wholly or partially fluorinated. Preferred silicones are polydimethylsiloxanes, which may optionally be derivatized and are then amino-functional or quaternized or comprise Si—OH, Si—H and/or Si—Cl bonds. The viscosities of the preferred silicones at 25° C. lie in the range between 100 and 100,000 mPa·s, it being possible to use the silicones in quantities of between 0.2 and 5 wt. %, relative to the total agent.

Finally, the detergents and cleaning agents may also contain UV absorbers, which attach to the treated textile fabrics and improve the lightfastness of the fibers. Compounds which have these desired properties are for example compounds active as a result of radiationless deactivation and derivatives of benzophenone with substituents in positions 2 and/or 4. Also suitable are substituted benzotriazoles, acrylates phenyl-substituted in position 3 (cinnamic acid derivatives), optionally with cyano groups in position 2, salicylates, organic Ni complexes and natural materials such as umbelliferone and endogenous urocanic acid.

To prevent decomposition catalyzed by heavy metals of certain detergent ingredients, substances may be used which complex heavy metals. Suitable heavy metal complexing agents are for example the alkali metal salts of ethylenediaminetetraacetic acid (EDTA) or nitrilotriacetic acid (NTA) and alkali metal salts of anionic polyelectrolytes such as polymaleates and polysulfonates.

A preferred class of complexing agents comprises phosphonates, which are contained in preferred liquid detergents and cleaning agents in quantities of from 0.01 to 2.5 wt. %, preferably 0.02 to 2 wt. % and in particular 0.03 to 1.5 wt. %. These preferred compounds include in particular organophosphonates such as for example 1-hydroxyethane-1,1-diphosphonic acid (HEDP), aminotri(methylenephosphonic acid) (ATMP), diethylenetriamine penta(methylenephosphonic acid) (DTPMP or DETPMP) and 2-phosphonobutane-1,2,4-tricarboxylic acid (PBS-AM), which are generally used in the form of their ammonium or alkali metal salts.

The liquid detergents and cleaning agents are produced using conventional, known methods and processes in which for example the constituents are simply mixed together in agitated tanks, with water, optionally present non-aqueous solvents and surfactant(s) usually being initially introduced and the further constituents being added in portions. Separate heating during production is unnecessary, but if it is desired the temperature of the mixture should not exceed 80° C. The granules according to the invention may be dispersed stably in the aqueous liquid detergents and cleaning agents. The agents are normally stable at room temperature and at 40° C. for a period of at least 4 weeks and preferably of at least 6 weeks, without the granules according to the invention creaming or sedimenting. Preferred liquid agents have densities of 0.5 to 2.0 g/cm$^3$, in particular 0.7 to 1.5 g/cm$^3$. The difference in density between the granules and the liquid phase of the agent amounts preferably to no more than 10% of the density of one of the two and is in particular so slight that the granules according to the invention and preferably also optionally other solid particles contained in the agents float in the liquid phase.

While particular embodiments of the present invention have been illustrated and described, it would be obvious to those skilled in the art that various other changes and modifications can be made without departing from the spirit and scope of the invention.

Other than where otherwise indicated, or where required to distinguish over the prior art, all numbers expressing quantities of ingredients herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined herein otherwise. The conjunction "or" is used herein in both in the conjunctive and disjunctive sense, such that phrases or terms conjoined by "or" disclose or encompass each phrase or term alone as well as any combination so conjoined, unless specifically defined herein otherwise.

The description of a group or class of materials as suitable or preferred for a given purpose in connection with the invention implies that mixtures of any two or more of the members of the group or class are equally suitable or preferred. Description of constituents in chemical terms refers unless otherwise indicated, to the constituents at the time of addition to any combination specified in the description, and does not necessarily preclude chemical interactions among the constituents of a mixture once mixed. Steps in any method disclosed or claimed need not be performed in the order recited, except as otherwise specifically disclosed or claimed.

Changes in form and substitution of equivalents are contemplated as circumstances may suggest or render expedient. Although specific terms have been employed herein, such terms are intended in a descriptive sense and not for purposes of limitation.

The following Examples further illustrate the preferred embodiments within the scope of the present invention, but are not intended to be limiting thereof. It is understood that the examples and embodiments described herein are for illustrative purposes only and that various modifications or changes in light thereof will be suggested to one skilled in the art without departing from the scope of the present invention. The appended claims therefore are intended to cover all such changes and modifications that are within the scope of this invention.

EXAMPLES

Example 1

91 parts by weight of hydrous phthalimidoperoxohexanoic acid (EURECO® W, 70% dry solids) were granulated with 4.5 parts by weight of Na-alginate powder in a Lödige®) ploughshare mixer. Then, 4.5 parts by weight of a 15 wt. % calcium nitrate solution were added. The resultant granules were dried and screened to a particle size range of from 1.0 mm to 2.0 mm.

The degree of retention of the phthalimidoperoxohexanoic acid in the resultant granules, which had been added to a hydrous liquid detergent test matrix, was 73% after two weeks' storage at 35° C.

Example 2

200 g of phthalimidoperoxohexanoic acid (EURECO®, ground to particle sizes of less than 0.8 mm) were combined with 110 g of a 4 wt. % aqueous Na-alginate solution in a Lodige® ploughshare mixer. The resultant paste was combined with a further 227 g of the same grade of phthalimidoperoxohexanoic acid and granulated. The resultant primary granules were stirred into a 2 wt. % calcium nitrate solution. The resultant granules were filtered out, dried and screened to a particle size range of from 1.5 mm to 2.5 mm.

The degree retention of the phthalimidoperoxohexanoic acid in the resultant granules, which had been added to a hydrous liquid detergent test matrix, was 81% after two weeks' storage at 35° C.

What is claimed:

1. A method of producing bleaching agent granules, comprising the steps of granulating particles comprising a peroxy compound with an ionotropically crosslinkable water-soluble polymer and a hydrous liquid binder to yield primary granules, and contacting the primary granules with a crosslinking agent for the ionotropically crosslinkable water-soluble polymer, wherein the granulating comprises an agglomeration step and/or a compacting step, and further wherein the granulating is carried out in a granulating mixer or a fluidized bed apparatus.

2. The method of claim 1, wherein the particulate peroxy compound comprises one or more alkali metal perborates, percarbonates, persulfates, diacyl peroxides, peroxocarboxylic acids, or mixtures thereof.

3. The method of claim 1, wherein the hydrous binder is dispensed into the granulating mixer as a constituent of a preparation comprising the particulate peroxy compound and/or of a preparation comprising the ionotropically crosslinkable polymer.

4. The method of claim 1, wherein the particulate peroxy compound comprises a phthalimidoperoxycarboxylic acid.

5. The method of claim 4, wherein the phthalimidoperoxycarboxylic acid comprises a phthalimidoperoxycaproic acid.

6. The method of claim 1, wherein the particulate peroxy compound comprises an aliphatic diacyl peroxide of the general formula R'—C(O)—O—O—C(O)—R", in which R' and R" mutually independently in each case denote an alkyl group with 8 to 20 carbon atoms.

7. The method of claim 1, wherein the ionotropically crosslinkable polymer comprises one or more of carrageenan, alginate, gellan gum, pectic acid, or mixtures thereof.

8. The method of claim 1, wherein the crosslinking agent is added to the primary granules in the mixer or the fluidized bed, the crosslinking agent being introduced as an aqueous solution.

9. The method of claim 1, wherein the primary granules are introduced into an aqueous solution of the crosslinking agent, then removed therefrom again, and optionally dried.

10. The method of claim 9, wherein the primary granules are removed from the aqueous solution of crosslinking agent by filtration.

11. The method of claim 1, wherein the particles comprising the peroxy compound comprise up to 95% by weight of peroxy compound.

12. The method of claim 11, wherein the particles comprising the peroxy compound comprise 50% to 85% by weight of peroxy compound.

* * * * *